US012435587B2

(12) United States Patent
Andersen

(10) Patent No.: US 12,435,587 B2
(45) Date of Patent: Oct. 7, 2025

(54) WIRELINE EXPANSION TOOL

(71) Applicant: Welltec A/S, Allerød (DK)

(72) Inventor: Tomas Sune Andersen, Allerød (DK)

(73) Assignee: Welltec A/S, Allerød (DK)

( * ) Notice: Subject to any disclaimer, the term of this patent is extended or adjusted under 35 U.S.C. 154(b) by 0 days.

(21) Appl. No.: 18/121,774

(22) Filed: Mar. 15, 2023

(65) Prior Publication Data

US 2023/0295994 A1 Sep. 21, 2023

(30) Foreign Application Priority Data

Mar. 16, 2022 (EP) ..... 22162467

(51) Int. Cl.
*E21B 23/04* (2006.01)

(52) U.S. Cl.
CPC ..... *E21B 23/0419* (2020.05); *E21B 23/0412* (2020.05)

(58) Field of Classification Search
CPC .. E21B 23/0412; E21B 23/0419; E21B 29/10; E21B 43/105
See application file for complete search history.

(56) References Cited

U.S. PATENT DOCUMENTS 9,316,077 B2 * 4/2016 Clemens ..... E21B 23/04
11,441,375 B2 * 9/2022 Roane ..... E21B 23/0422
2010/0307774 A1 12/2010 Tinnen
2012/0312561 A1 * 12/2012 Hallundbaek et al. . E21B 29/10 166/207
2015/0308240 A1 * 10/2015 Hallundbæk ..... E21B 43/103 166/387

(Continued)

OTHER PUBLICATIONS

Extended European Search Report for EP Application No. 22162467.9 dated Sep. 8, 2022, 8 pages.

*Primary Examiner* — Nicole Coy
*Assistant Examiner* — Nicholas D Wlodarski
(74) *Attorney, Agent, or Firm* — Nixon & Vanderhye P.C.

(57) ABSTRACT

The present invention relates to a wireline expansion tool for setting of a completion tubular component such as a straddle, a liner, a patch or a liner hanger, the wireline expansion tool having an axial extension and comprising an electric motor connectable with and powered through a wireline, an axial force generator driven directly or indirectly by the electric motor for providing a movement along the axial extension, a radial expansion tool section connected with the axial force generator, and a completion tubular component, arranged at least partly around at least part of the radial expansion tool section for expanding at least part of the completion tubular component, wherein the radial expansion tool section comprises a first element movable along the axial extension by the axial force generator and a support structure connected with the first element, the support structure supporting the completion tubular component during expansion, and the first element being connected with the support structure for moving the support structure at least partly radially outwards for simultaneous expanding the completion tubular component. The invention also relates to a downhole tool string comprising the wireline expansion tool and a driving unit, such as a downhole tractor, for propelling the wireline expansion tool forward in the well.

20 Claims, 6 Drawing Sheets

(56) References Cited

U.S. PATENT DOCUMENTS

Figure 1:
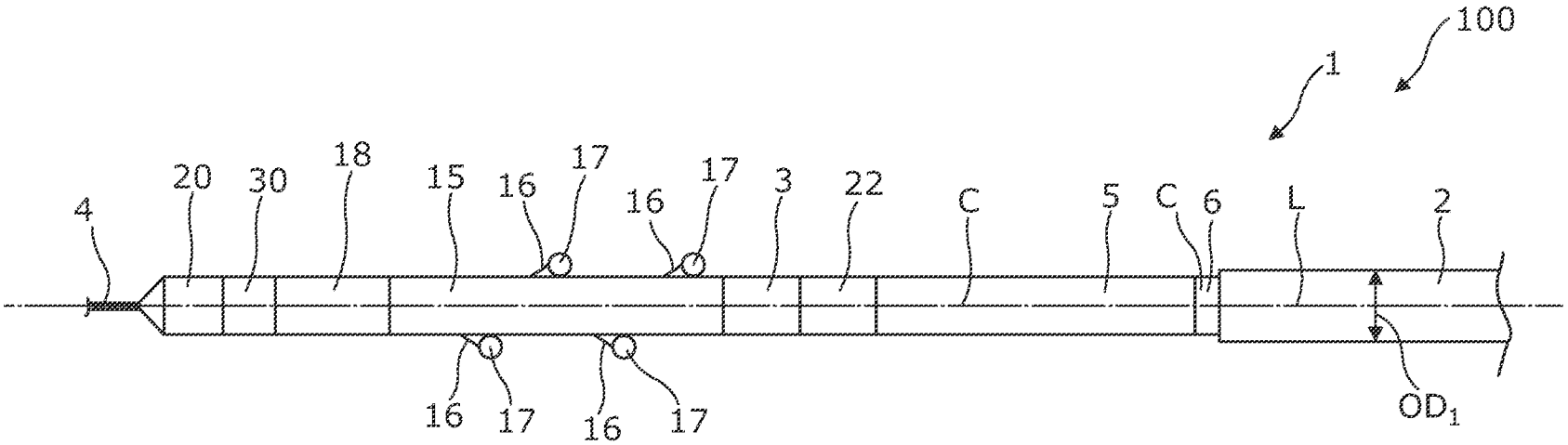

| | | | | |
|---|---|---|---|---|
| 2016/0032695 | A1* | 2/2016 | Luke | E21B 43/103<br>166/382 |
| 2019/0226299 | A1* | 7/2019 | Andersen | E21B 43/26 |
| 2021/0071496 | A1* | 3/2021 | Brown | E21B 23/01 |
| 2021/0230957 | A1 | 7/2021 | Kunz | |

* cited by examiner

WIRELINE EXPANSION TOOL

CROSS-REFERENCE TO RELATED APPLICATIONS

This application claims priority to EP patent application Ser. No. 22162467.9 filed Mar. 16, 2022, the entire contents of which are hereby incorporated by reference.

The present invention relates to a wireline expansion tool for setting of a completion tubular component such as a straddle, a liner, a patch or a liner hanger, the wireline expansion tool having an axial extension. The invention also relates to a downhole tool string comprising the wireline expansion tool and a driving unit, such as a downhole tractor, for propelling the wireline expansion tool forward in the well.

When a casing is leaking, a patch may be expanded in order to seal off the leak. The patches are expanded by filling a bladder with liquid. However, when expanding the bladder by liquid for expanding the patch there is a risk that the patch may crack, and sometimes the bladder cannot be reused as the bladder cannot always be fully retracted after expansion.

It is an object of the present invention to wholly or partly overcome the above disadvantages and drawbacks of the prior art. More specifically, it is an object to provide an improved wireline expansion tool in which an axial force generator can be used for expanding a completion tubular component.

The above objects, together with numerous other objects, advantages and features, which will become evident from the below description, are accomplished by a solution in accordance with the present invention by a wireline expansion tool for setting of a completion tubular component such as a straddle, a liner, a patch or a liner hanger, the wireline expansion tool having an axial extension and comprising:

- an electric motor connectable with and powered through a wireline,
- an axial force generator,
- a radial expansion tool section, and
- the completion tubular component arranged at least partly around at least part of the radial expansion tool section for expanding at least part of the completion tubular component, wherein the radial expansion tool section comprises a first element moving along the axial extension and a support structure connected with the first element for moving the support structure at least partly radially outwards for expanding at least part of the completion tubular component.

The above objects, together with numerous other objects, advantages and features, which will become evident from the below description, are accomplished by a solution in accordance with the present invention by a wireline expansion tool for setting of a completion tubular component such as a straddle, a liner, a patch or a liner hanger, the wireline expansion tool having an axial extension and comprising:

- an electric motor connectable with and powered through a wireline,
- an axial force generator driven directly or indirectly by the electric motor for providing a movement along the axial extension,
- a radial expansion tool section connected with the axial force generator, and
- a completion tubular component arranged at least partly around at least part of the radial expansion tool section for expanding at least part of the completion tubular component, wherein the radial expansion tool section comprises a first element movable along the axial extension by the axial force generator and a support structure connected with the first element, the support structure supporting the completion tubular component during expansion, and the first element being connected with the support structure for moving the support structure at least partly radially outwards for simultaneously expanding the completion tubular component.

Moreover, the completion tubular component may be fully expanded.

By "expanded" is meant that an outer diameter of the completion tubular component enlarges, not necessarily that the material itself is expanded. The completion tubular component may unwind during expansion.

Also, the axial force generator may further comprise a housing and a shaft having a first shaft end closest to the electric motor and a second shaft end, the shaft being arranged in the housing in a retracted position, and the first element being connected to the second shaft end.

Furthermore, the housing may be stationary, and the shaft may be moving within the housing.

In addition, the shaft may be stationary, and the housing may be moving in relation to the electric motor.

Further, the axial force generator may comprise a first piston element projecting radially outwards from the shaft, the first piston element abutting an inner face of the housing.

Moreover, the axial force generator may comprise a second piston element projecting radially inwards from the housing, the second piston element abutting an outer face of the shaft.

Additionally, the wireline expansion tool may further comprise a pump driven by the electric motor, wherein a first chamber is formed between the first piston element, the second piston element, the shaft and the housing, fluid channels fluidly connecting the pump and the chamber for pumping fluid into and out of the chamber for moving the first element.

Also, the fluid channel may extend in the housing or in the shaft.

Furthermore, the axial force generator may comprise a second chamber, the fluid being pumped between the first chamber and the second chamber.

In addition, the radial expansion tool section may further comprise a second element, the first element being configured to move towards the second element in order to move the support structure radially outwards to expand the completion tubular component.

Moreover, the support structure may only partly support the completion tubular component along the circumference of the completion tubular component.

Further, the support structure may only scatteredly support the completion tubular component along the circumference of the completion tubular component.

Also, the support structure may only discontinuously support the completion tubular component along the circumference of the completion tubular component.

In addition, the support structure may only partly support the completion tubular component along the length of the completion tubular component.

Furthermore, the completion tubular component may have a length and a circumference, and the completion tubular component may be expanded along the entire length.

Moreover, the completion tubular component may also be expanded along the entire circumference.

Also, the completion tubular component may be a metal sheet having a first end and a second end opposite the first end, and the metal sheet being wound so that the first end overlaps the second end.

Further, the second element may be connected to the housing or may be part of the housing.

Moreover, the completion tubular component may be a metal sheet having a first end and a second end opposite the first end, and the metal sheet may be wound so that the first end overlaps the second end.

Furthermore, the first end may overlap the second end more than one time before expansion.

Also, the completion tubular component may be made of spring metal.

In addition, the completion tubular component may be a rolled metal sheet forming a tubular shape, thus forming an overlapping area.

Further, the completion tubular component may comprise a layer of adhesive between metal sheet layers in the overlapping area.

Moreover, the support structure may have an internal face having a first inclined face and a second inclined face, the first element having a third inclined face abutting the first inclined face so that when the first element is moved towards the electric motor, the support structure moves radially outwards.

Additionally, the second element may have a fourth inclined face abutting the second inclined face so that when the first element is moved towards the electric motor, the support structure moves radially outwards.

Also, the support structure may comprise a plurality of support parts having at least one groove extending along a circumference of the tool and a locking ring or circlip engaging the grooves and pressing the support parts towards a centre axis of the tool and in this way holding the support parts together while expanding radially outwards perpendicularly to the centre axis.

Furthermore, the support structure may be an elastomeric element compressed by the first element moving towards the housing so that the elastomeric element bulges radially outwards in such way that part of the elastomeric element moves radially outwards along with the completion tubular component.

In addition, the support structure may comprise a plurality of support parts having a first end connected to the first element and a second end connected with the housing, the support parts being distributed around the circumference of the tool so that when the first element moves towards the housing, the support parts bend radially outwards, moving the completion tubular component radially outwards.

Further, the support structure may comprise a plurality of support parts having a first end rotatably connected to the first element and a second end rotatably connected with the housing, each support part comprising a first part, a second part and an intermediate part arranged intermediately to the first part and the second part and at each end being rotatably connected to the first part and the second part, respectively.

Finally, the invention relates to a downhole tool string comprising the wireline expansion tool and a driving unit, such as a downhole tractor, for propelling the wireline expansion tool forward in the well.

Figure 2A:
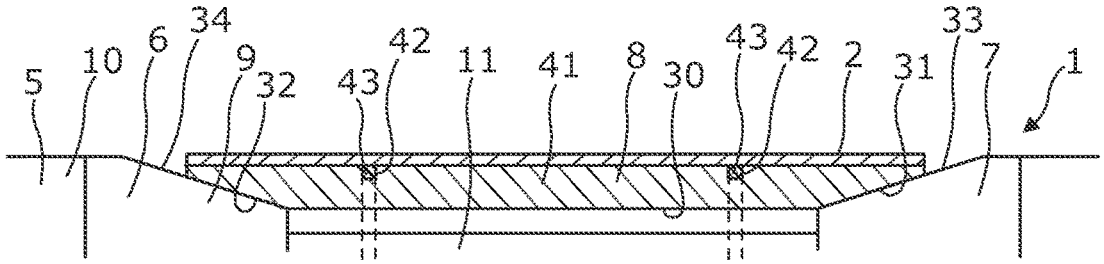
Figure 2B:
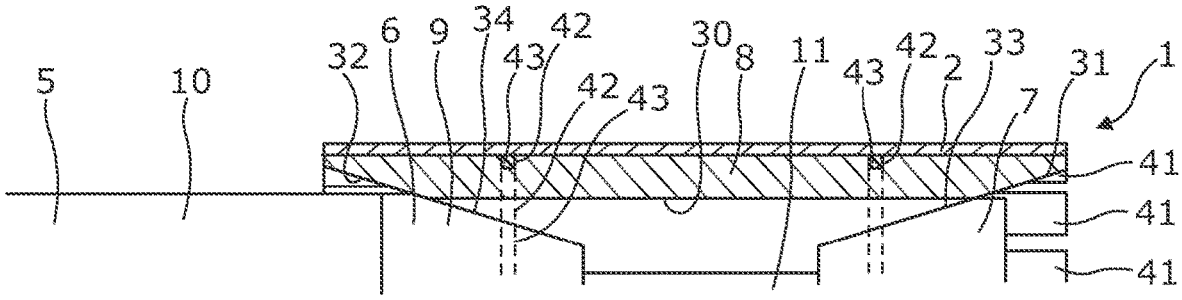
Figure 3A:
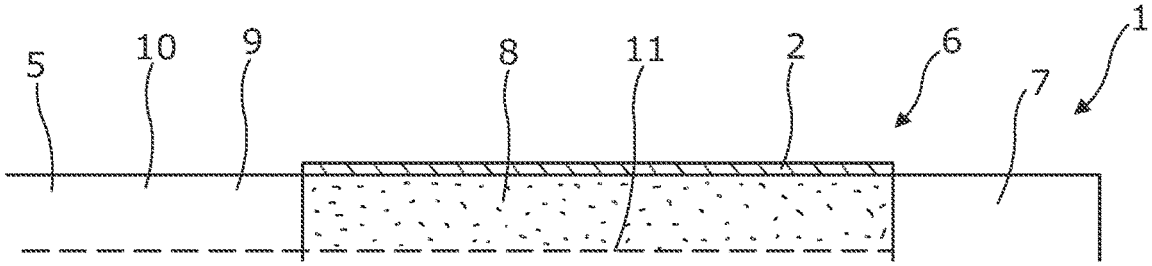
Figure 3B:
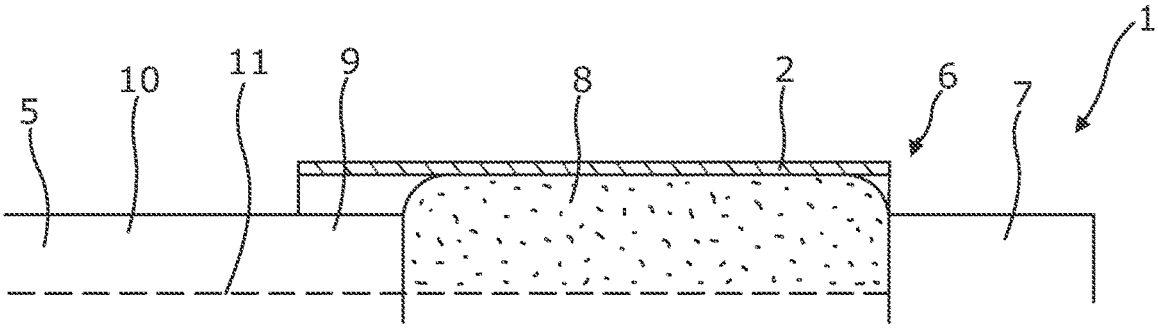
Figure 4A:
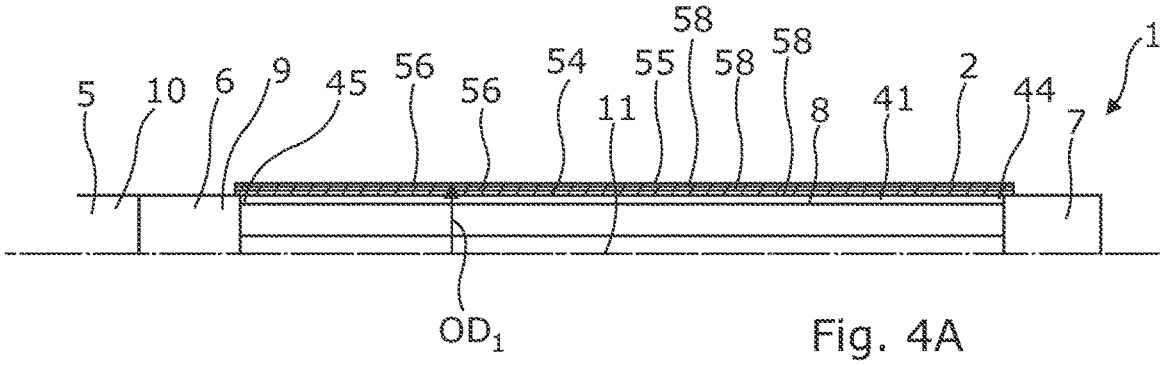
Figure 4B:
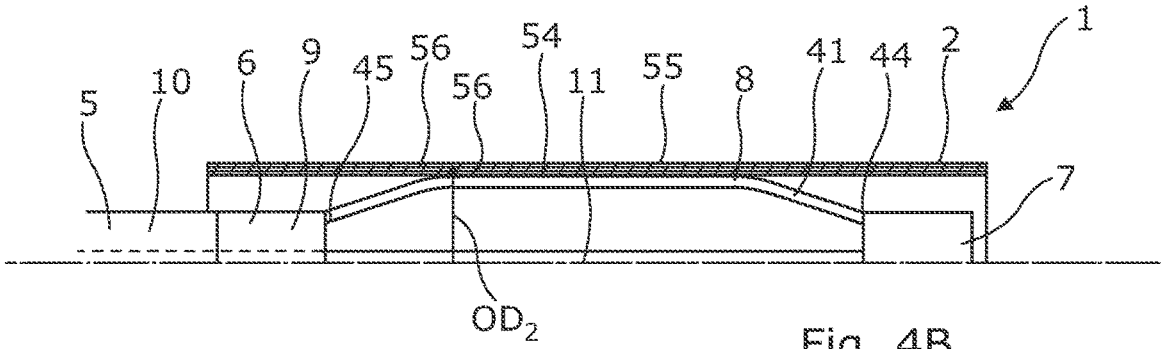
Figure 5A:
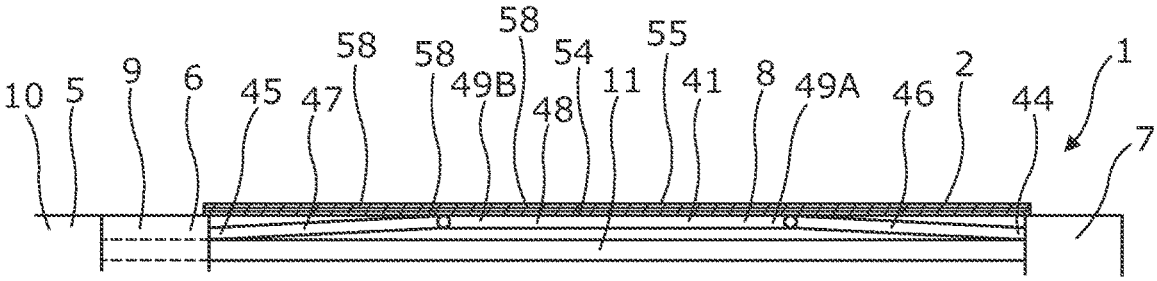
Figure 5B:
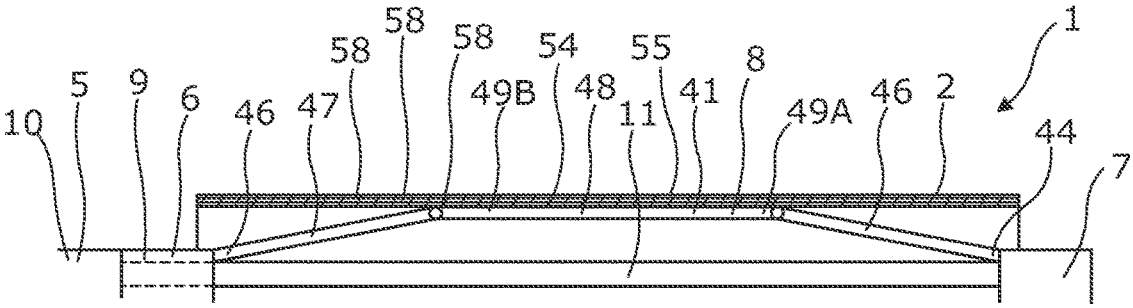
Figure 6:
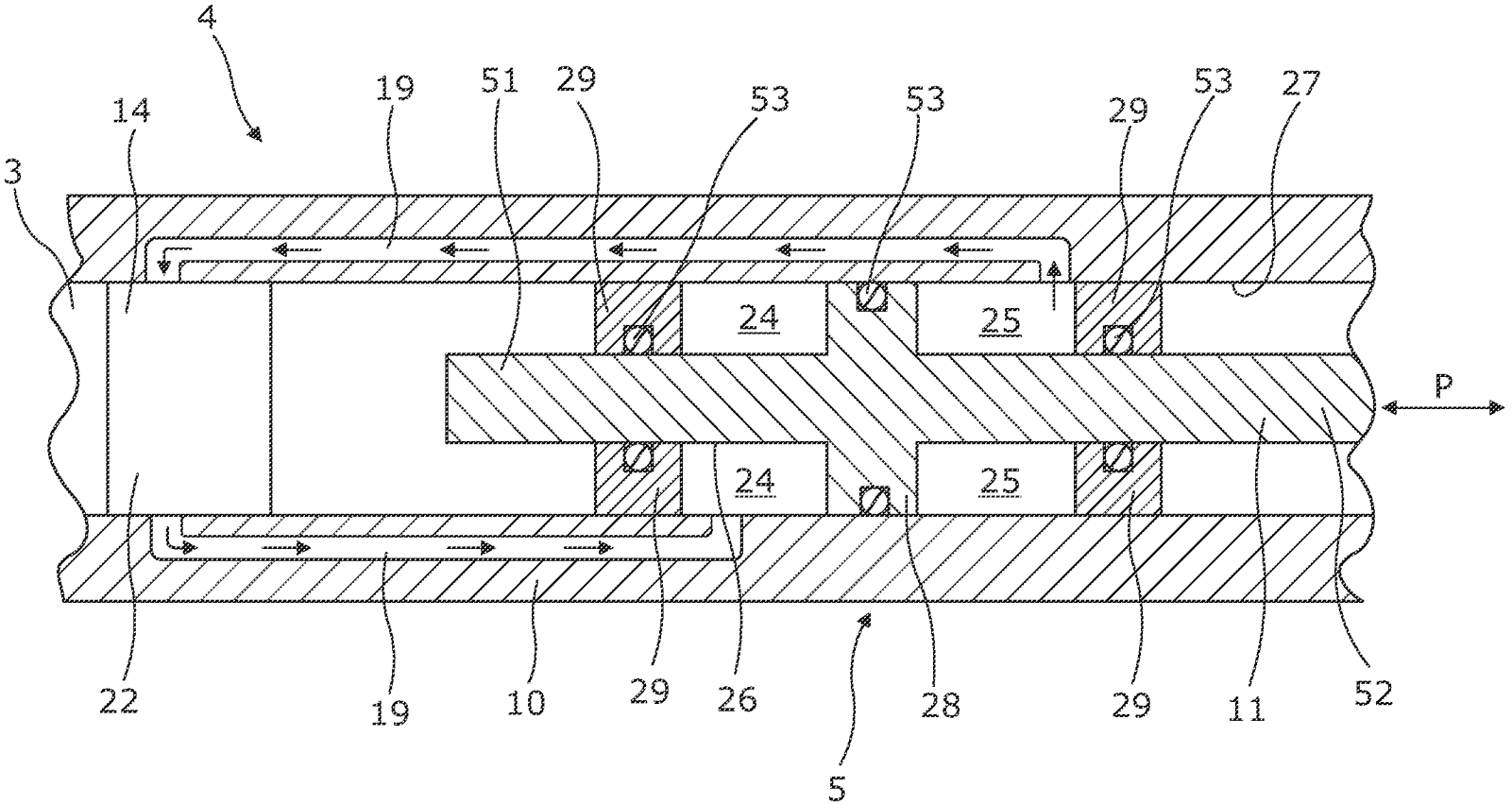
Figure 7A:
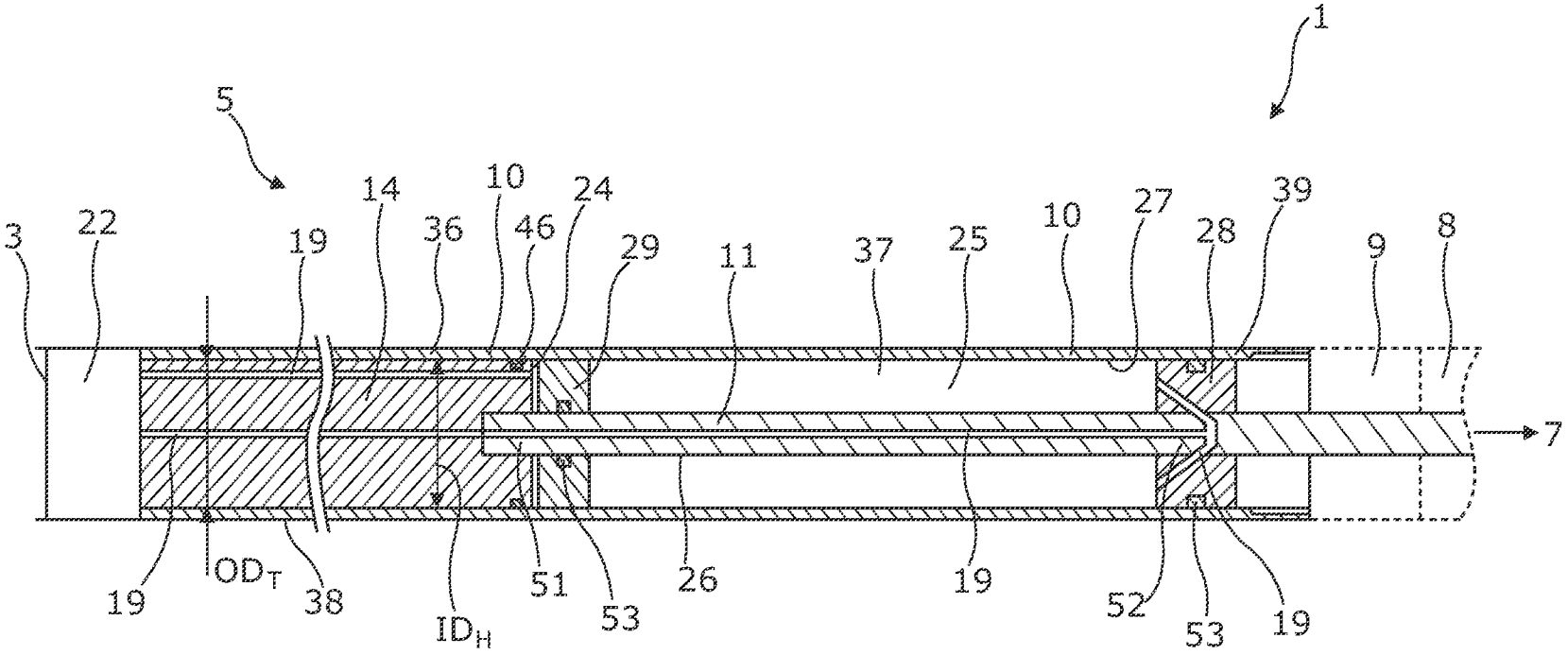
Figure 7B:
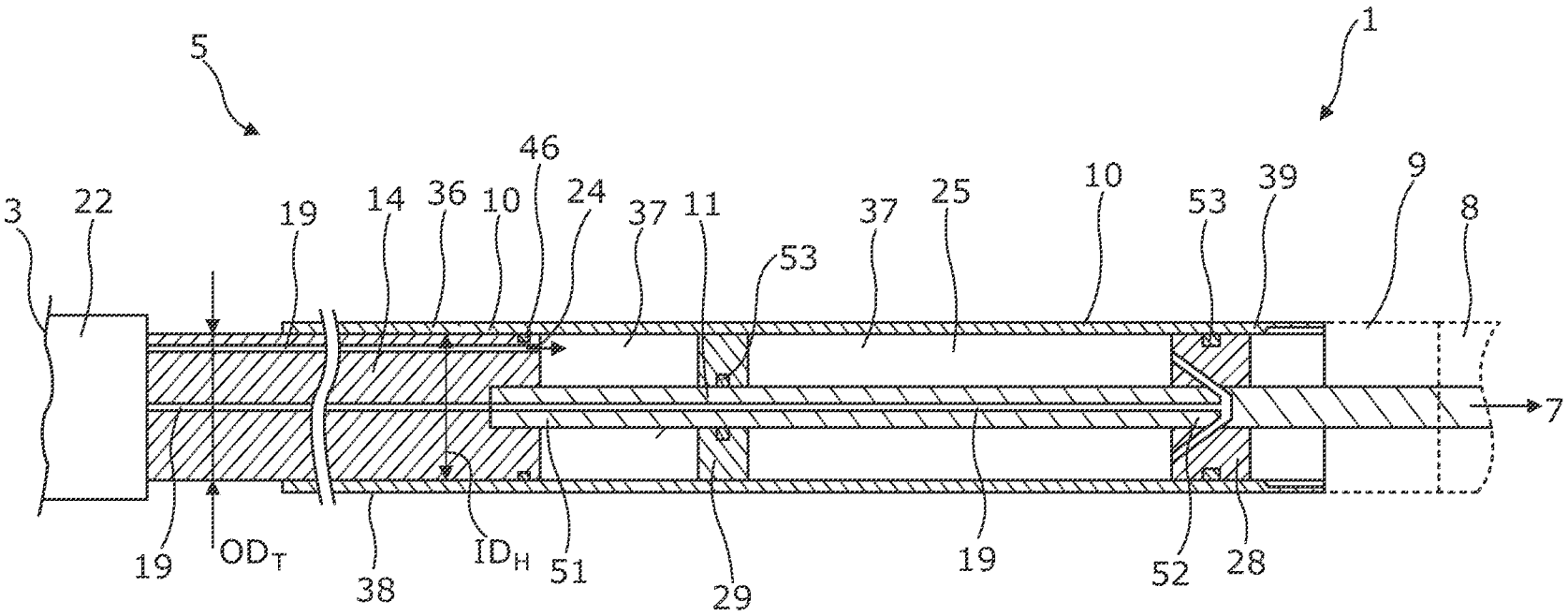

The invention and its many advantages will be described in more detail below with reference to the accompanying schematic drawings, which for the purpose of illustration show some non-limiting embodiments and in which:

FIG. 1 shows a wireline expansion tool having a radial expansion tool section for setting of a tubular component, such as a patch, surrounding part of the radial expansion tool section, FIG. 2A shows a partly cross-sectional view of part of a radial expansion tool section before expansion of the completion tubular component, FIG. 2B shows a partly cross-sectional view of the radial expansion tool section of FIG. 2A after expansion of the completion tubular component, FIG. 3A shows a partly cross-sectional view of part of another radial expansion tool section before expansion of the completion tubular component, FIG. 3B shows a partly cross-sectional view of the radial expansion tool section of FIG. 3A after expansion of the completion tubular component, FIG. 4A shows a partly cross-sectional view of part of yet another radial expansion tool section before expansion of the completion tubular component, FIG. 4B shows a partly cross-sectional view of the radial expansion tool section of FIG. 4A after expansion of the completion tubular component, FIG. 5A shows a partly cross-sectional view of part of another radial expansion tool section before expansion of the completion tubular component, FIG. 5B shows a partly cross-sectional view of the radial expansion tool section of FIG. 5A after expansion of the completion tubular component, FIG. 6 shows a partly cross-sectional view of an axial force generator having a shaft for generating the axial force to the radial expansion tool section, FIG. 7A shows a partly cross-sectional view of an axial force generator having a housing for generating the axial force to the radial expansion tool section in its retracted position, and FIG. 7B shows a partly cross-sectional view of the axial force generator of FIG. 7A in its projected position.

All the figures are highly schematic and not necessarily to scale, and they show only those parts which are necessary in order to elucidate the invention, other parts being omitted or merely suggested.

FIG. 1 shows a wireline expansion tool 1 for setting of a completion tubular component 2 such as a straddle, a liner, a patch or a liner hanger within a well tubular metal structure. In FIG. 1, the completion tubular component 2 is shown as a patch, but could be any of the components mentioned. The wireline expansion tool 1 has an axial extension L and a centre axis C. The wireline expansion tool 1 is powered through a wireline 4 from surface, e.g. on an offshore or onshore rig, and comprises an electric motor 3 connectable with and powered through the wireline 4, an axial force generator 5 driven by the electric motor 3 and a radial expansion tool section 6 activated by the axial force generator 5. The completion tubular component 2 is arranged at least partly around at least part of the radial expansion tool section 6 and is shown in a first condition having a first outer diameter $OD_1$ (shown in FIG. 4A) before changing to a second condition having a second outer diameter $OD_2$ as shown in FIG. 4B. When changing condition from the first to the second condition, the completion tubular component 2 may be expanding or uncurling if the completion tubular component is made of a sheet, e.g. of spring metal, having overlapping ends forming a completion tubular component. Thus, the completion tubular component may be a wound metal sheet of spring steel where the ends are overlapping more in the initial condition than after expansion. The radial expansion tool section 6 comprises a first element 7 moving along the axial extension L and a support structure 8 supporting the completion tubular component 2 and connected with the first element 7 for moving the support structure 8 at least partly radially outwards for expanding at least part of the completion tubular component 2. Lubrication may be applied between the outer face of the support structure 8 and the inner face of the completion tubular component 2 so that the component is free to move during expansion, thus reducing the risk of the component fracturing during the expansion process.

In FIG. 1, the wireline expansion tool 1 is part of a downhole tool string 100 comprising the wireline expansion tool 1 and a driving unit 15, such as a downhole tractor, for propelling itself and the wireline expansion tool 1 forward in the well. The driving unit 15 comprises a pump 18 for driving wheels 17 on arms 16 to rotate and for projecting the arms radially outwards. The driving unit 15 comprises an electric motor 3B powered by the wireline for driving the pump 18. The downhole tool string 100 further comprises a control unit 20.

As shown in FIGS. 6, 7A and 7B, the axial force generator 5 further comprises a housing 10 and a shaft 11 having a first shaft end 51 closest to the electric motor 3 and a second shaft end 52. The shaft 11 is arranged in the housing 10 in a retracted position, and the first element 7 is connected to the second shaft end 52. In FIG. 6, the housing 10 is stationary, and the shaft 11 is moving within the housing 10. In FIGS. 7A and 7B, the shaft 11 is stationary, and the housing 10 is moving in relation to the electric motor 3. The axial force generator 5 comprises a first piston element 28 projecting radially outwards from the shaft 11, the first piston element 28 abutting an inner face 27 of the housing 10. The axial force generator 5 comprises a second piston element 29 projecting radially inwards from the housing 10, the second piston element 29 abutting an outer face 26 of the shaft 11. The first piston element 28 and the second piston element 29 comprise a surrounding sealing element 53.

The wireline expansion tool 1 further comprises a pump 22 driven by the electric motor 3, and a first chamber 25 is formed between the first piston element 28, the second piston element 29, the shaft 11 and the housing 10. Fluid channels 19 fluidly connect the pump 22 and the first chamber 25 for pumping fluid into and out of the chamber 25 for moving the first element 7. In FIG. 6, the fluid channel 19 extends mainly in the housing 10, and in FIGS. 7*a* and 7B the fluid channel 19 extends in the shaft 11 and in a tool part 14. The axial force generator 5 comprises a second chamber 24, and the fluid is pumped between the first chamber 25 and the second chamber 24 in order to move the first element 7. The pump 22 may pump fluid out of the piston housing/housing 10 on one side and simultaneously suck fluid in on the other side of the piston.

As shown in FIGS. 2A and 2B, the radial expansion tool section 6 further comprises a second element 9, and the first element 7 is configured to move towards the second element 9 in order to move the support structure 8 radially outwards to expand the completion tubular component 2. The second element 9 is connected to the housing 10 in FIGS. 2A and 2B and is part of the housing 10 in FIGS. 3A and 3B.

In FIGS. 2A and 2B, the support structure 8 has an internal face 30 having a first inclined face 31 facing away from the housing 10 and a second inclined face 32 facing towards the housing 10. The first element 7 has a third inclined face 33 facing towards the housing 10 and abutting the first inclined face 31, and the second element 9 has a fourth inclined face 34 facing away from the housing 10 and abutting the second inclined face 32 so that when the first element 7 is moved towards the electric motor 3, the support structure 8 moves radially outwards. As the first element 7 moves towards the housing 10, the abutting inclined faces force the support structure 8 outwards in a radial direction perpendicular to the axial extension of the tool, and as the support structure 8 is supporting the completion tubular component 2, the completion tubular component 2 is likewise forced radially outwards, either expanding or uncoiling until abutting the inner face of a surrounding casing or borehole wall for setting the completion tubular component 2 in the well. The expanding or uncoiling occurs until the completion tubular component 2 cannot move any further radially outwards. The support structure 8 comprises a plurality of support parts 41, each having two grooves 42 extending along a circumference of the tool and a locking ring 43 or circlip engaging the grooves 42 and pressing the support parts 41 towards a centre axis C of the tool, and in this way the support parts 41 are held together while expanding radially outwards perpendicularly to the centre axis C. The support parts 41 are thus squeezed in between the completion tubular component 2 and the first element 7 and the second element 9. The completion tubular component 2 may be a straddle, a liner, a patch or a liner hanger. The straddle and the patch may be a tubular component made by coiling a plate-shaped metal sheet having overlapping ends and which uncoils during the expansion. The shaft 11 thus extends through the second element 9.

As shown in FIGS. 2A and 2B, the support structure discontinuously supports the completion tubular component 2 along the circumference of the completion tubular component 2. The support structure fully supports the completion tubular component 2 along the length of the completion tubular component 2. In another embodiment, the support structure only partly supports the completion tubular component 2 along the length of the completion tubular component 2.

In FIGS. 3A and 3B, the support structure 8 is an elastomeric element being compressed by the first element 7 moving towards the housing 10 so that the elastomeric element bulges radially outwards, as shown in FIG. 3B, in such way that part of the elastomeric element moves radially outwards along with the completion tubular component 2 and thus partly expands. As the elastomeric element supports the patch 2, the patch is likewise expanded, such as uncoiled. As shown in FIGS. 3B and 4B, the support structure only partly supports the completion tubular component 2 along the length of the completion tubular component 2 in the expanded condition.

In FIGS. 4A and 4B, the support structure 8 also comprises a plurality of support parts 41 having a first end 44 connected to the first element 7 and a second end 45 connected to the housing 10 or to the second element 9. The support parts 41 are distributed around the circumference of the tool so that when the first element 7 moves towards the housing 10, the support parts 41 bend radially outwards, moving the completion tubular component 2 radially outwards as shown in FIG. 4B.

In FIGS. 5A and 5B, the support structure 8 comprises a plurality of support parts 41 having a first end 44 rotatably connected to the first element 7 and a second end 45 rotatably connected with the housing 10. Each support part 41 comprises a first part 46, a second part 47 and an intermediate part 48. The intermediate part 48 is arranged intermediately to the first part 46 and the second part 47, and at each end (49A, 49B) the intermediate part 48 is rotatably connected to the first part 46 and the second part 47, respectively, from the initial and unexpanded position shown in FIG. 5B to the expanded position shown in FIG. 5B. As shown in FIGS. 5A and 5B, the support structure 8 discontinuously, i.e. scatteredly or pointwise, supports the completion tubular component 2 along the circumference of the completion tubular component 2. The support structure 8 only partly supports the completion tubular component 2 along the length of the completion tubular component 2 both before and after expansion.

The radial expansion tool sections 6 as shown in FIGS. 4A, 4B, 5A and 5B are mainly suitable for expansion by uncoiling of the completion tubular component 2, such as a straddle or a patch. The completion tubular component 2 is formed of a metal sheet, such as spring metal, having a first end 54 and a second end 55 opposite the first end, and the metal sheet being wound so that the first end overlaps the second end. Thus, the first end overlaps the second end more than one time before expansion, forming overlapping layers 58. The completion tubular component 2 is a rolled metal sheet forming a tubular shape and thus forming an overlapping area 56. The completion tubular component 2 comprises a layer 57 of adhesive between the metal sheet layers in the overlapping area 56. The outer face of the completion tubular component 2 may have an adhesive so that the overlapping ends of the completion tubular component 2 may be adhered/glued together after expansion by uncoiling. For this purpose, the support structure 8 may have heating means incorporated so that, after expansion, the support structure 8 can heat the completion tubular component 2 and initiate the adhering of the overlapping ends.

Thus, by having the wireline expansion tool 1 where the support structure 8 only partly supports the completion tubular component 2 along only part of the circumference and/or the length of the completion tubular component 2, the wireline expansion tool 1 is able, in an easy manner, to set the completion tubular component 2 formed of a rolled metal sheet since the tool only has pointwise contact with the inner face of the completion tubular component because the rolled metal sheet has an inherent unrolling force for making the completion tubular component abut the wall of the borehole or the well tubular metal structure for sealing a leaking area therein. In known solutions, the support structure of the radial expansion tool section 6 needs to support the entire length and the entire circumference for the completion tubular component 2, such as a patch, to provide a seal of the leaking zone. Providing such full support along both the entire length and the entire circumference of the completion tubular component 2 has proven to be very challenging as the completion tubular component 2 shrinks in length during expansion, and a fluidly expanded bladder bulges outwards at the free ends (from the shrinking), as a result of which the completion tubular component 2 is not fully expanded as the bladder is no longer able to continue the expansion, and the "bulged part" of the bladder also creates a distance to the wall of the borehole or well tubular metal structure, preventing full expansion.

In FIG. 6, the housing 10 is stationary, and the shaft 11 is moving within the housing 10, and fluid channels 19 in the housing wall provide fluid communication between the pump 22 and the first and second chambers 25, 24 in order to move the shaft 11. Thus, when running in hole, the second chamber 24 is at its maximum so that the shaft 11 is projected out of the housing 10 to its maximum, and when the first element 7 is to be moved, the pump flow is in the opposite direction of that shown in FIG. 6 so that the pump 22 pumps fluid into the first chamber 25, retracting the shaft 11 into the housing 10 and thus moving the first element 7 towards the housing 10.

FIG. 7A shows an axial force generator 5, also called a downhole stroking tool, for providing an axial force P in an axial direction of the wireline expansion tool 1, which is also the axial direction of a well for pulling the first element 7 towards the housing 10. The axial force generator 5 comprises a housing 10, a first chamber inside the axial force generator 5 and a first tool part 14 comprising a pump 22 for providing pressurised fluid to the chambers 25, 24. The wireline expansion tool 1 further comprises an electric motor 3 and an electronic section/control unit 20 for controlling the function of the wireline expansion tool 1. The wireline expansion tool 1 is electrically powered through the wireline 4.

In FIG. 7A, the axial force generator 5 comprises a shaft 11 penetrating the chamber 37, the first piston element 28 and the second piston element 29 dividing the chamber 37 into a first chamber 25 and a second chamber 24. The second piston element 29 forms part of the housing 10, which forms part of a second tool part 36. The second tool part 36, the housing 10 and the second piston element 29 are slidable in relation to the shaft 11 and the first tool part 14 so that the housing 10 moves in relation to the shaft 11, and the shaft 11 is stationary in relation to the pump 22 during pressurisation of the first or the second chamber 25, 24. The fluid is fed to one of the chambers 25, 24 through a fluid channel 19 in the first tool part 14 and a fluid channel 19 in the shaft 11 for providing fluid to and/or from the chambers 25, 24 during pressurisation of the first or the second chamber 25, 24, generating pressure on the second piston element 29.

The pressurisation of the chamber 24 generates pressure on the second piston element 29 and a downstroke movement in that the housing 10 moves down, away from the pump 22, as shown in FIG. 7B, where the second element 9 is moved towards the first element 7 for activating and moving the support structure 8 at least partly radially outwards for expanding at least part of the completion tubular component 2. While fluid is led into the second chamber 24, fluid is forced out of the first chamber 25. When providing pressurised fluid into the first chamber 25, pressure is generated on the second piston element 29, providing an upstroke movement in that the housing 10 moves from the position shown in FIG. 7B to the position shown in FIG. 7A and thus moves towards the pump 22. The shaft 11 is fixedly connected with the first tool part 14, and the housing 10 is slidable in relation to the first tool part 14, a first end part 38 of the housing 10 overlapping the first tool part 14. When overlapping, the housing 10 is supported partly by the first tool part 14 since the first tool part 14 has an outer diameter $OD_T$ which is substantially the same as an inner diameter $ID_H$ of the housing 10. The housing 10 comprises a second end part 39 connected to the second element 9, illustrated by dotted lines.

As the shaft 11 is fixed and the housing 10 with the piston is slidable, the force generated by the axial force generator 5 is mainly transferred via the housing 10, and not via the shaft 11. When transferring a high force close to the centre of the axial force generator 5, and if the axial force generator 5 is not fully aligned with the element it presses onto, the shaft 11 bends easier than when being aligned with the element. When transferring the high axial force mainly via the housing 10, the force is transferred further away from the centre, thus eliminating the risk of bending part of the axial force generator 5 when it is off the centre in relation to the element. The axial force generator 5 is therefore capable of transferring a higher amount of force than the axial force generator 5 shown in FIG. 6 as the risk of the shaft 11 bending during the transfer of a high force is substantially reduced. The axial force generator 5 can provide a force of 100,000 pounds. Furthermore, by moving the housing 10 in relation to the stationary shaft 11 and the stationary first tool part 14, a higher bending stiffness of the axial force generator 5 is obtained. The housing 10 is supported along its stroke by the second piston element 29, whereby the axial force generator 5 is capable of transferring a high axial force substantially without bending.

Furthermore, since the shaft 11 is fixed and the housing 10 with the piston is sliding, the shaft 11 does not transfer any force and thus does not have to have a certain diameter, and the shaft diameter can therefore be reduced and the piston area increased, enabling the tool 1 to generate a higher axial force.

In another embodiment, the tool 1 is powered by a battery in the tool and is thus wireless. In yet another embodiment, not shown, the pump may be powered by high-pressure fluid from surface down through a pipe, coiled tubing or casing.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "tubular component" is meant a component forming a channel and being tubular in shape, and having an inner diameter and an outer diameter forming a wall therebetween, one part of the wall potentially overlapping another part of the wall in order to form the tubular shape.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor 15 may have projectable arms 16 having wheels 17, wherein the wheels contact the inner surface of the casing or borehole for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A wireline expansion tool for setting of a completion tubular component, the wireline expansion tool having an axial extension and comprising:

an electric motor connectable with and powered through a wireline, an axial force generator driven directly or indirectly by the electric motor for providing a movement of at least a portion of the axial force generator along the axial extension, a radial expansion tool section connected with the axial force generator, and a completion tubular component arranged at least partly around at least part of the radial expansion tool section for expanding at least part of the completion tubular component into abutment with a borehole or a well tubular metal structure, the completion tubular component being configured to allow fluid communication from one end to the other when the radial expansion tool section is removed after expansion of the completion tubular component, wherein the radial expansion tool section comprises a first element that is mechanically connected with the portion of the axial force generator where the axial movement of the portion of the axial force generator along the axial extension is configured to move the first element along the axial extension, and a support structure connected with the first element, the support structure supporting the completion tubular component during expansion or uncoiling of the completion tubular component while the portion of the axial force generator and the first element move along the axial extension, and the first element being connected with the support structure for moving the support structure at least partly radially outwards for simultaneous expanding the completion tubular component.

2. A wireline expansion tool according to claim 1, wherein the axial force generator further comprises a housing and a shaft having a first shaft end closest to the electric motor and a second shaft end, the shaft being arranged in the housing in a retracted position, and the first element being connected to the second shaft end.

3. A wireline expansion tool according to claim 2, wherein the housing is stationary, and the shaft is moving within the housing.

4. A wireline expansion tool according to claim 2, wherein the shaft is stationary, and the housing is moving in relation to the electric motor.

5. A wireline expansion tool according to claim 2, wherein the axial force generator comprises a first piston element projecting radially outwards from the shaft, the first piston element abutting an inner face of the housing.

6. A wireline expansion tool according to claim 5, wherein the axial force generator comprises a second piston element projecting radially inwards from the housing, the second piston element abutting an outer face of the shaft.

7. A wireline expansion tool according to claim 6, further comprising a pump driven by the electric motor, wherein a first chamber is formed between the first piston element, the second piston element, the shaft and the housing, fluid channels fluidly connecting the pump and the chamber for pumping fluid into and out of the chamber for moving the first element.

8. A wireline expansion tool according to claim 7, wherein the axial force generator comprises a second chamber, and the fluid is pumped between the first chamber and the second chamber.

9. A wireline expansion tool according to claim 1, wherein the radial expansion tool section further comprises a second element, the first element being configured to move towards the second element in order to move the support structure radially outwards to expand the completion tubular component.

10. A wireline expansion tool according to claim 1, the completion tubular component being a metal sheet having a first end and a second end opposite the first end, and the metal sheet being wound so that the first end overlaps the second end.

11. A wireline expansion tool according to claim 1, wherein the support structure has an internal face having a first inclined face and a second inclined face, the first element having a third inclined face abutting the first inclined face so that when the first element is moved towards the electric motor, the support structure moves radially outwards.

12. A wireline expansion tool according to claim 1, wherein the support structure comprises a plurality of support parts having at least one groove extending along a circumference of the tool and a locking ring engaging the grooves and pressing the support parts towards a centre axis of the tool and in this way holding the support parts together while expanding radially outwards perpendicularly to the centre axis.

13. A wireline expansion tool according to claim 2, wherein the support structure comprises a plurality of support parts having a first end connected to the first element and a second end connected with the housing, the support parts being distributed around the circumference of the tool so that when the first element moves towards the housing, the support parts bend radially outwards, moving the completion tubular component radially outwards.

14. A wireline expansion tool according to claim 2, wherein the support structure comprises a plurality of support parts having a first end rotatably connected to the first element and a second end rotatably connected with the housing, each support part comprising a first part, a second part and an intermediate part arranged intermediately to the first part and the second part, and at each end being rotatably connected to the first part and the second part, respectively.

15. Downhole tool string comprising the wireline expansion tool according to claim 1 and a driving unit, such as a downhole tractor, for propelling the wireline expansion tool forward in the well.

16. A wireline expansion tool according to claim 1, wherein completion tubular component is a patch, a liner, a liner hanger or a straddle.

17. A wireline expansion tool according to claim 1, wherein completion tubular component is a patch that is hollow along its longitudinal axis, such that once the patch is expanded or uncoiled to abut the borehole or the well tubular metal structure and the tool is removed, fluid communication through the patch is enabled.

18. A wireline expansion tool according to claim 1, wherein the axial force generator is configured to move the first element along the axial extension relative to the support structure whilst also causing radial expansion of the support structure and the completion tubular.

19. A wireline expansion tool according to claim 1, wherein the support structure is configured to be uncoiled or expanded exclusively based on axial movement of the first element to cause radial movement of the support structure, without the introduction of pressurized fluid within the support structure.

20. A wireline expansion tool according to claim 1, wherein the support structure and the first element are configured and arranged to convert an axial force from the first element into radial expansion or uncoiling of the support structure without an inflatable bladder.

* * * * *